US005262268A

United States Patent [19]

Bertrand et al.

[11] Patent Number: 5,262,268

[45] Date of Patent: Nov. 16, 1993

[54] METHOD OF PIGMENT DISPERSION IN COLORED TONER

[75] Inventors: Jacques C. Bertrand, Ontario; Don B. Jugle, Rochester, both of N.Y.

[73] Assignee: Xerox Corporation, Stamford, Conn.

[21] Appl. No.: 847,399

[22] Filed: Mar. 6, 1992

[51] Int. Cl.[5] ..... G03G 9/09

[52] U.S. Cl. ..... 430/137

[58] Field of Search ..... 430/137, 106

[56] References Cited

U.S. PATENT DOCUMENTS

| | | | |
|---|---|---|---|
| 2,479,836 | 8/1949 | Hoback et al. | 260/22 |
| 3,607,335 | 9/1971 | Belde et al. | 106/308 |
| 3,728,142 | 4/1973 | Rudolph et al. | 106/300 |
| 3,754,956 | 8/1973 | Durrant et al. | 106/300 |
| 3,778,287 | 12/1973 | Stansfield et al. | 106/308 |
| 4,028,128 | 6/1977 | Robertson | 106/308 |
| 4,054,465 | 10/1977 | Ziobrowski | 106/298 |
| 4,233,388 | 11/1980 | Bergen et al. | 430/137 |
| 4,247,338 | 1/1981 | Ziobrowski | 106/298 |
| 4,391,648 | 7/1983 | Ferrill et al. | 106/308 |
| 4,623,604 | 11/1986 | Takagiwa et al. | 430/109 |
| 4,894,308 | 1/1990 | Mahabadi et al. | 430/137 |
| 5,124,226 | 6/1992 | Yabuuchi et al. | 430/137 |

*Primary Examiner*—John Goodrow

*Attorney, Agent, or Firm*—Oliff & Berridge

[57] ABSTRACT

A pigment wet cake is blended and extruded directly with a resin and other constituents in the manufacture of a toner.

20 Claims, No Drawings

METHOD OF PIGMENT DISPERSION IN COLORED TONER

FIELD OF THE INVENTION

This invention relates to a method of dispersing colorant in a toner resin.

BACKGROUND

An electrostatographic printing machine such as a photocopier, laser printer, facsimile machine or the like employs an imaging member that is exposed to an image to be printed. Exposure of the imaging member records an electrostatic latent image on it corresponding to the informational areas contained within the image to be printed. The latent image is developed by bringing a developer material into contact therewith. The developed image is transferred to a support material such as paper either directly or via an intermediate transport member. The developed image on the support material is generally subjected to heat and/or pressure to permanently fuse the image to the support material.

Many types of developer compositions, including both dry developer compositions and liquid developer compositions, have been proposed for use in the development of latent electrostatic images.

In liquid developer compositions, various types of colorant and dye are attached to a resin dispersed in an insulating liquid carrier. In the so-called dry type developing method, colorant is dispersed in a fine powder.

Conventionally, toner for developing electrostatically charged images may be produced by melt-mixing the soft polymer and pigment whereby the pigment is dispersed in the polymer. The polymer having the colorant dispersed therein is then pulverized.

Normally, pigments are created in a chemical reaction in an aqueous phase. The pigment particles are filtered and washed. In the pigment manufacturing process, an aqueous slurry called a wet cake may be produced which is about 40% to about 85% by weight water, with about 50% by weight water being typical.

The amount of pigment necessary for the optimal color in a colored xerographic toner is critically dependent upon its dispersion within a toner; the better the dispersion, the higher the chroma for less pigment. Very good dispersions of colored pigments in a polymer matrix can be obtained by using a process called flushing. At present, some of the best dispersions are obtained by flushing the pigment into the resin to be used for making the toner.

Flushing is believed to involve the following process. The wet cake is put into a mixer to which is added a solution of a polymer such as Pliotone®, a styrene-butadiene compound manufactured by Goodyear, and a solvent, such as toluene. The solution is gently mixed and the organic phase of the solution is adsorbed by the pigment. The water from the aqueous phase is displaced and poured off. The remaining solvent in the solution is removed by a vacuum as the solution continues to be mixed. The molten mass that results is comprised of about 50% pigment and about 50% polymer. The mass is cooled and crushed. Additional resin may be added, and all of the ingredients may be melt-mixed in an extruder.

This process is believed to work because in the wet cake form the pigment particles are kept isolated from one another by a layer of water surrounding them. The polymer solution displaces the water because the solution preferentially wets the pigment particles. When the water is separated it is simply poured off and the solvent is vacuum evaporated so that each particle is now surrounded by a film of polymer; hence a high quality dispersion is possible.

This process is very costly, as it requires the use of a solvent and a relatively large quantity of pigment for the correct chroma. It also requires a number of manufacturing steps and monitoring equipment.

However, if this process is not used and the pigments are simply allowed to dry or are force dried before mixing with resin, the particles agglomerate and are extremely difficult to separate, even in high shear melt mixing processes such as extrusion or in a mill.

U.S. Pat. No. 4,623,604 (Takagiwa et al.) discloses a triboelectric stabilized toner for developing electrically charged images comprising nuclear particles formed by polymerization, hydrophobic silica, and a resin. The resin is coated on the nuclear particles and the silica is dispersed in the resin. The resin is dissolved in a solvent. The solvent exerts a lesser solvating action against the nuclear particles than against the resin to form a solution. The hydrophobic silica in the solution is then dispersed, the nuclear particles are mixed in the dispersion and the mixture is dried. Drying is achieved by means of a process which may include air drying, decompression drying or spray drying by a spray drier. The solvent is removed and a toner with a resin coated layer is obtained.

The use of liquid pigment dispersions as colorants for paints and inks is also known. In U.S. Pat. No. 3,778,287 (Stansfield et al.) dispersions of inorganic pigments, lakes or toners in organic liquids containing polyesters dissolved therein having acid values up to 100 derived from certain hydroxy-containing, saturated or unsaturated aliphatic carboxylic acids are described. While liquid colorants offer the distinct advantage of being more readily incorporated into the medium to be colored than dry pigments, their commercial significance is seriously limited due to the problems of handling and storing potentially hazardous liquid chemicals. Thus, from an economic and safety standpoint, it is desirable to have the colorants in a dry, storage stable form which is readily dispersible in a wide variety of coating media without detriment to any of the desirable properties of coating produced therefrom.

U.S. Pat. No. 3,607,335 (Belde) discloses pigment dye formulations which contain the pigment dye dispersed in diglycol terephthalates or linear oligomers of terephthalic acid and ethylene glycol in plastic filaments or threads. The pigment formulations are manufactured in a batch process in which the pigment-dyes are flushed with polymer and kneaded from one to four hours.

U.S. Pat. No. 4,391,648 (Ferrill) discloses particulate pigment compositions which are readily dispersible in oleoresinous vehicle systems wherein the compositions comprise by weight from 25–95% pigment and 5–75% of water-insoluble, friable thermoplastic polyester resins. The pigments can be in the form of a dry lump, wet cake, or slurry of the pigments in an organic solvent. Press cakes are preferred to avoid aggregation that occurs during drying. The compositions of the invention can be formed in any convenient manner for intimately mixing a pigment with a normally solid resin, as for example, by ball milling in a dry state, pebble milling in an aqueous medium, high speed stirring in the presence of a solvent for the resin, and the like, and then removing any aqueous medium or solvent. Conveniently, the compositions are prepared by forming an aqueous dispersion of the pigment, preferably by stirring the pigment in water in the presence of a surfactant, adding the resin to the aqueous dispersion and agitating the aqueous pigment-resin slurry at a temperature above the softening temperature of the resin. No extruder is used to disperse the pigment in the resin.

U.S. Pat. No. 4,054,465 (Ziobrowski) discloses lead chromate-containing pigments having improved dispersibility, heat stability and resistance to abrasion in thermoplastic systems. The pigments comprise silica coated lead chromate-containing particles having absorbed on their surface from 1-15% based on the weight of the coated particles of certain liquid organopolysiloxanes. The improved lead chromate-containing pigments of this invention are produced by depositing on the lead chromate-containing particles at least one substantially continuous coating of dense amorphous silica, with or without alumina, or a solid glass-like alkali polysilicate, and contacting the coated particles with certain liquid organopolysiloxanes. Following application of the silica coating to the lead chromate particles, the coated particles are contacted with a liquid organopolysiloxane under conditions which do not effect substantial polymerization a curing of the polysiloxane. The coated pigment can be in the form of a ground dried lump, a wet cake, a slurry of the coated pigment in water, or an inert organic diluent. The mixture is ground or vigorously agitated at room temperature in a blender. The liquid polysiloxane can also be applied directly, as by sprinkling on the dry coated pigment and then grinding wetted pigment in a high speed grinding device.

In the examples given in the patent, the pigments, except for one of the control pigments, are pre-treated prior to being dry blended with commercial injection grade polystyrene granules and the blended sample is twice passed through a Sterling laboratory extruder. There is no indication that the untreated pigment is in the formula of a wet cake, nor is the invention directed towards an improved method of manufacturing toner.

U.S. Pat. No. 4,247,338 (Ziobrowski) discloses a metal chromate pigment composition, particularly a lead chromate composition, which exhibits low dusting characteristics and improved heat stability in thermoplastics. The pigment particles are treated with a combination of certain metal salts or fatty acids and plasticizers. The lead chromate particles with or without a silica or silica aluminum coating are in the form of a ground dried lump, wet cake, a slurry of the pigment in water or a suitable organic diluent. The pigment, fatty acid and plasticizer are mixed. In the examples given in the patent, the pigments, except for one of the control pigments, are pretreated prior to being dry blended with commercial polypropylene pellets, passing the blended sample thrice through an extruder. There is no indication that the untreated pigment is in the form of a wet cake, nor is the invention directed towards an improved method of manufacturing toner.

In U.S. Pat. No. 4,894,308 (Mahabadi et al.), a process for preparing an electrophotographic toner is disclosed which comprises premixing and extruding a pigment, a charge control additive and a resin. The pigment and the charge control additive may be premixed prior to being added to the extruder with the resin; alternatively, the pigment and charge control additive may be premixed by adding them to the extruder via an upstream supply means and extruding them, and subsequently adding the resin to the extruder via a downstream supply means. There is no mention of the use of pigment in the form of a wet cake.

SUMMARY OF THE INVENTION

It is an object of this invention to produce a quality dispersion equal to the quality of flushed pigments by using direct extrusion of wet cake pigments into a polymer.

It is an object of this invention to improve dispersions of colorants in a polymer matrix of a toner.

It is a further object of the invention to reduce the amount of pigment used for a higher chroma.

Another object of the invention is to reduce environmental hazards and disposal costs in the manufacture of a toner.

In this invention, a pigment wet cake is "dry" blended directly with the resin and other constituents in the manufacture of a toner.

The colorant is a pigment in the form of a wet cake. By using a wet cake of the pigment instead of obtaining a more refined version of the pigment, the costs of manufacturing the toner are greatly reduced. Additionally, refining the pigment normally encompasses using toxic or hazardous solvents which in turn creates a hazardous waste problem for man and the environment. This process eliminates the need for the use of toxic solvents.

DETAILED DESCRIPTION OF PREFERRED EMBODIMENTS

The toner created by the process of this invention comprises a resin, a colorant, and preferably a charge control additive and other known additives.

Numerous pigments can be used in this process, including but not limited to:

| Pigment Brand Name | Manufacturer | Pigment Color Index |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow TY-858-D | Heubach | Yellow 74 |
| Hansa Yellow X | Hoechst | Yellow 75 |
| Novoperm ® Yellow HR | Hoechst | Yellow 75 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L75-1331 Yellow | Sun Chem. | |
| L75-2377 Yellow | Sun Chem. | |
| Hostaperm ® Orange GR | Hoechst | Orange 43 |
| Paliogen ® Orange | BASF | Orange 51 |
| Irgalite ® 4BL | Ciba-Geigy | Red 57:1 |
| Fanal Pink | BASF | Red 81 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L6901F | BASF | Blue 15:2 |
| Heliogen ® Blue NBD7010 | BASF | |

-continued

| Pigment Brand Name | Manufacturer | Pigment Color Index |
|---|---|---|
| Heliogen ® Blue K7090 | BASF | Blue 15:3 |
| Heliogen ® Blue L7101F | BASF | Blue 15:4 |
| Paliogen ® Blue L6470 | BASF | Blue 60 |
| Heliogen ® Green K8683 | BASF | Green 7 |
| Heliogen ® Green L9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | |
| Mogul L | Cabot | |
| BK 8200 Black Toner | Paul Uhlich | |

Any suitable toner resin can be mixed with a pigment. Examples of suitable toner resins which can be used include but are not limited to polyamides, epoxies, diolefins, polyurethanes, vinyl resins and polymeric esterification products of a dicarboxylic acid and a diol comprising a diphenol. Any suitable vinyl resin may be selected for the toner resins of the present application, including homopolymers or copolymers of two or more vinyl monomers. Typical vinyl monomeric units include: styrene, p-chlorostyrene, vinyl naphthalene, unsaturated mono- olefins such as ethylene, propylene, butylene, and isobutylene; vinyl halides such as vinyl chloride, vinyl bromide, vinyl fluoride, vinyl acetate, vinyl propionate, vinyl benzoate, vinyl butyrate, and the like; vinyl esters such as esters of monocarboxylic acids including methyl acrylate, dodecyl acrylate, n-octyl acrylate, 2- chloroethyl acrylate, phenyl acrylate, methylalphachloroacrylate, methyl methacrylate, ethyl methacrylate, and butyl methacrylate; acrylonitrile, methacrylonitrile, acrylimide; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; styrene butadiene copolymers, Pliolites, available from Goodyear Company, and mixtures thereof. A preferred resin with which the wet cake pigment is mixed is Pliotone ®, a styrene-butadiene resin manufactured by Goodyear.

Particularly preferred are resins comprising poly-n-butylmethacrylate, a copolymer of styrene and butadiene which comprises 89 percent by weight of styrene and 11 percent by weight of butadiene, and a copolymer of styrene and n-butyl methacrylate which comprises 58% by weight of styrene and 42 percent by weight of n-butyl methacrylate.

The resin or resins are generally present in the resin-toner mixture in an amount of from about 50 percent to about 99 percent by weight of the toner composition, and preferably from about 80 percent to about 99 percent by weight. Pigments generally make up the remainder of these mixtures.

Additional components of the toner may be added to the resin prior to mixing the resin with the pigment. Alternatively, these components may be added after the resin and the pigment have been mixed but prior to extrusion. Some of the additional components may be added after extrusion, such as the charge control additives, particularly when the pigmented toner is to be used in a liquid developer. These components include but are not limited to stabilizers, waxes, and charge control additives.

Various known suitable effective charge control additives can be incorporated into the toner compositions of the present invention, such as quaternary ammonium compounds and alkyl pyridinium compounds, including cetyl pyridinium halides and cetyl pyridinium tetrafluoroborates, as disclosed in U.S. Pat. No. 4,298,672, the disclosure of which is totally incorporated herein by reference, distearyl dimethyl ammonium methyl sulfate, and the like. Particularly preferred as a charge control agent is cetyl pyridinium chloride. The charge enhancing additives are usually present in the final toner composition in an amount of from about 1 percent by weight to about 20 percent by weight.

Other additives may also be present in toners obtained by the process of the present invention. External additives may be applied, for example, in instances such as when toner flow is to be assisted, or when lubrication is needed to assist a function such as cleaning of the photoreceptor. The amounts of external additives are measured in terms of percentage by weight of the toner composition, but are not themselves included when calculating the percentage composition of the toner. For example, a toner composition containing a resin, a pigment, and an external additive may comprise 80 percent by weight resin and 20 percent by weight pigment; the amount of external additive present is reported in terms of its percent by weight of the combined resin and pigment.

External additives may include any additives suitable for use in electrostatographic toners, including fumed silica, silicon derivatives such as Aerosil ® R972, available from Degussa, Inc., ferric oxide, hydroxy terminated polyethylenes such as Unilin, polyolefin waxes, which preferably are low molecular weight materials, including those with a molecular weight of from about 1,000 to about 20,000, and including polyethylenes and polypropylenes, polymethylmethacrylate, zinc stearate, chromium oxide, aluminum oxide, titanium oxide, stearic acid, polyvinylidene fluorides such as Kynar, and other known or suitable additives. External additives may be present in any amount, provided that the objectives of the present invention are achieved, and preferably are present in amounts of from about 0.1 to about 1 percent by weight. For the process of the present invention, these additives may preferably be introduced into the resin prior to mixing with the pigment.

The wet cake pigment, the resin and any or all additives may be mixed together, preferably in a high energy mixing device such as a Loedige Blender. The pigment, resin and additives are first mixed in the blender with low plow speed, usually at about 200 rpm to about 600 rpm. After several minutes, for example, about 2 to about 6 minutes, the speed of the blender or mixer is increased and the chopper blades are turned on, at about, for example, 3400 rpm for 1 minute to thoroughly mix the pigment, resin, and additives, and to chop up the wet cake. The pigment may still dry out to some extent, but at room temperature, the agglomeration is expected to be minimal.

After the toner ingredients have been mixed, they are further blended, preferably in an extruder. Generally, any extruder, such as a single or twin screw extruder, suitable for preparing electrophotographic toners, may be employed.

In a preferred twin screw extruder, there are three specific temperature zones. In the feed zone, resin, additive and pigment are metered into the extruder. The temperature is maintained below the resin melt point. If the resin begins to melt at the feed port, the entry clogs, and the extruder often stalls.

In the mixing zone, the temperature of the barrel is held just above the resin melting point, bringing the conveyed mass to a high viscosity, molten state. Reverse directing screw elements cause the advancing blend to swirl backwards into the forward-moving blend, causing a rise in pressure. In this high energy state, residual pigment particles are crushed and blended into the molten resin. Pigment and optional additives mix uniformly into the liquified resin. If, during this stage, the temperature is temporarily lowered, the resin viscosity increases.

At the discharge port, the temperature is raised up to about 170° C. or to a temperature which fluidizes the extrudate and causes it to flow freely out the exit. The pressure in the preceding mixing zone can be increased by restricting the size of the exit hole, at the expense of throughput.

The screws are preferably turned at the fastest rate which allows the molten resin to achieve the desired temperatures. Faster screw speeds provide higher energy mixing and greater throughputs, but above a certain rate, the resin is moving too fast to equilibrate with the barrel temperature, and dispersion quality degrades.

As an example, a Werner Pfleiderer WP-28 extruder equipped with a 15 horsepower motor is well-suited for melt-blending a resin, a pigment wet cake, and additives. This extruder has a 28 mm barrel diameter, and is considered semiworks-scale, running at peak throughputs of about 3 to 12 lbs./hour.

When extruded, any remaining water on the pigment is "driven away" due to the high temperature and shear forces of the extruder, and the fact that due to surface tension forces, the resin has a greater affinity for the pigment than for the water. Vacuum may preferably be used to remove the vaporized water from the extruder.

Dispersion quality improves when a "masterbatch" process is used. The resin is first mixed with a very high loading of pigment, for example 50% for cyan, magenta, and yellow, and 30% for black. The pigment acts as a self-grinding medium. The finished extrudate is then milled to a coarse powder and mixed, or "let down" with pure resin to lower pigment loading to the desired value. The mixture is passed through the extruder to produce the final product.

This masterbatch process is carried out in two discrete extrusions. An improved process begins as a normal batch, where a rich pigment-resin mixture is introduced at the feed port. This is melted and mixed, and at the end of the mixing zone, additional molten resin is injected into the extruder, and mixed in the next heating zone of the extruder. The product has the dispersion quality of the product of a full masterbatch process, but is delivered from the extruder at the proper pigment loading in a single pass.

An important property of toners is brittleness which causes the resin to fracture when impacted. This allows rapid particle size reduction in attritors, other media mills, or even jet mills used to make dry toner particles.

After the resin and the pigment have been melt blended together, the resin-pigment mixture is reduced in size by any suitable method including those known in the art.

A pulverizer may be also used for this purpose. The pulverizer may be a hammer mill such as, for example, an Alpine® Hammer Mill. The hammer reduces the toner particles to a size of about 100 μm to about 300 μm.

Prior to pulverizing the toner particles, a rotary cutter, such as an Alpine® Cutter or Fitz® Miller, may be used to reduce the size of the resin particles.

A jet type micronizer such as a jet mill is preferred for micronization. Jet mills contain a milling section into which water vapor jets or air jets are blown at high speeds, and the solid matter to be micronized is brought in across an injector by a propellant. Compressed air or water vapor is usually used as the propellant in this process. The introduction of the solid matter into the injector usually occurs across a feeding hopper or an entry chute.

Milling aids are also often added to the solid matter in order to support the micronization.

For example, a Sturtevant 15 inch jet mill having a feed pressure of about 114 psi and a grinding pressure of about 119 psi may be used in the preparation of the toner resin particles. The nozzles of this jet mill are arranged around the perimeter of a ring. Feed material is introduced by a pneumatic delivery device and transported to the injector nozzle. The particles collide with one another and are attrited. These particles stay in the grinding zone by centrifugal force until they are small enough to be carried out and collected by a cyclone separator. A further size classification is performed by an air classifier.

Other methods may be used to reduce the size of the toner, including methods that may be applied when the toner will be used to form a liquid developer. Such methods include, for example, post-processing with an attritor, vertical or horizontal mills or even reducing toner particle size in a liquid jet interaction chamber. Additives such as charge control agents may be added to the liquid developer.

EXAMPLE 1

In one set of experiments, Fanal Pink (D4830) pigment is obtained from BASF in three different states:

a) Wet Cake (27% Pigment, 73% Water);
b) Flushed (40% Pigment, 60% Pliotone® Resin);
c) Dry (100% Pigment).

Each of these pigment forms is blended with Pliotone® resin to make 100 pounds of preblend so that the pigment concentration is a constant (about 5%). The pigments and resin are first mixed in a Loedige blender with plow speeds of 200 to 600 rpm. After 1–6 minutes, the chopper blades are turned on at speeds of between 1,400 and 3,400 rpm so that the pigment and resin are thoroughly mixed.

The mixture is then extruded in a Werner-Pfleiderer 28 extruder.

Photomicrographs of the extruded samples taken at 5000× magnification from a transmission electron microscope reveals that the wet cake has a pigment dispersion superior to that of the dry pigment, and a dispersion very close to or equal to the flushed pigment if the extruder has appropriate vacuum extraction system attached. Color measurements of the toners produced by the extrusion process of the wet cake pigments show superior color to the toners using dry pigments and equal to that of flushed pigment at the same concentration of pigments.

EXAMPLE 2

Heliogen Blue 15:3 from BASF Corp. and Sunfast Blue 15:3 from Sun Chemical are obtained in the wet cake form and the flushed form. The two sets of pigments are processed using the above processes but the final toner concentration is 2.5% by weight pigment.

With both pigments, the wet cake dispersion process produces pigment dispersions that are superior to the dry pigment process and which are very close to or equal with those produced by the flushed pigment process. These pigment dispersions are examined using transmission electron microscopy. The color analysis of the resulting toners show that toners using the wet cake process are higher in chroma than the toners produced by the dry powder process and are equal in chroma to the flushed pigment toners.

While the invention has been described with reference to the structures and embodiments disclosed herein, it is not confined to the details set forth, and encompasses such modifications or changes as may come within the purpose of the invention.

What is claimed is:

1. A method of forming a colored toner, comprising:

mixing a pigment wet cake directly into the toner resin in an extruder by melt-blending the toner resin and pigment wet cake; and removing water from said extruder.

2. The method of claim 1, further comprising premixing the pigment wet cake with the toner resin in a high energy mixer prior to extruding the pigment wet cake into the toner resin.

3. The method of claim 2, wherein said mixer is a blender.

4. The method according to claim 1, wherein said extruder is a twin screw extruder.

5. The method according to claim 1, wherein said water in contact with the pigment from said wet cake is displaced by said toner resin.

6. The method of claim 1, further comprising simultaneously adding additives into the extruder while the toner resin is mixing with the pigment wet cake.

7. The method of claim 1, further comprising adding other additives into the toner resin prior to mixing with the pigment wet cake.

8. The method of claim 6, wherein said additives are selected from the group consisting of stabilizers, waxes, charge control additives, and mixtures thereof.

9. The method of claim 1, further comprising removing water during the melt-blending step by applying a vacuum during the melt-blending of the resin and the pigment.

10. The method of claim 2, wherein the pigment wet cake is pre-mixed with the toner resin at room temperature.

11. The method of claim 1, wherein the extruder is operated at a temperature from above a melting point of the resin to a temperature which fluidizes extrudates and causes the extrudates to exit the extruder freely.

12. The method of claim 1, wherein the pigment wet cake comprises about 40% by weight water to about 85% by weight water, amd about 15% by weight pigment to about 60% by weight pigment.

13. The method of claim 1, wherein the colored toner comprises from about 1. % by weight pigment to about 20% by weight pigment, and from about 80% by weight resin to about 99% by weight resin.

14. A method of forming a colored toner, comprising:

forming a pigment wet cake with water;

melt-blending the wet cake directly into a toner resin to form a melt-blended mixture of toner resin and pigment wet cake; and removing water from the melt-blended mixture.

15. The method of claim 14, further comprising premixing the pigment wet cake with the toner resin prior to melt-blending the wet cake into the toner resin.

16. The method according to claim 14, wherein said water with the pigment wet cake is displaced by said toner resin.

17. The method of claim 14, further comprising adding other additives into the toner resin prior to melt-blending with the pigment wet cake.

18. The method of claim 14, further comprising removing said water by applying a vacuum during the melt-blending of the resin and the pigment wet cake.

19. The method of claim 15, wherein the pigment wet cake is pre-mixed with the toner resin at room temperature.

20. The method of claim 14, wherein the melt-blending step is carried out at a temperature from above a melting point of the resin to a temperature which fluidizes extrudates and causes the extrudates to exit the melt-blended mixture freely.

* * * * *